United States Patent [19]

Leppänen

[11] Patent Number: 4,708,533

[45] Date of Patent: Nov. 24, 1987

[54] METHOD AND A DEVICE FOR GUIDING A CONCRETE FEEDING HOSE IN CONNECTION WITH THE GROUT FEED IN ROCK BOLTING

[75] Inventor: Jarmo Leppänen, Ylöjärvi, Finland

[73] Assignee: Oy Tampella AB, Tampere, Finland

[21] Appl. No.: 922,413

[22] Filed: Oct. 23, 1986

[30] Foreign Application Priority Data

Nov. 7, 1985 [FI] Finland ..... 854379

[51] Int. Cl.[4] ..... E21D 20/02

[52] U.S. Cl. ..... 405/303; 401/261; 401/265; 137/355.12; 137/355.16; 141/367; 141/387; 222/530; 242/86.5 R; 226/199; 264/31; 405/260; 405/269; 425/59; 425/64

[58] Field of Search ..... 405/259, 260, 261, 303, 405/269; 137/355.22–355.28; 425/59, 63, 64, 87, 90, 110, 256; 264/31; 222/527, 529, 530, 320, 321; 141/279, 387, 388, 389, 367; 242/86, 86.2, 86.5 R, 54 A; 226/196, 199, 176; 401/261, 265

[56] References Cited

U.S. PATENT DOCUMENTS

| | | | |
|---|---|---|---|
| 1,969,324 | 8/1934 | Poulter | 405/269 X |
| 1,982,610 | 11/1934 | Harris | 137/355.23 X |
| 2,055,885 | 9/1936 | Weston | 264/31 |
| 2,176,891 | 10/1939 | Crom | 264/31 |
| 2,274,883 | 3/1942 | Brach | 242/54 A X |
| 2,286,904 | 6/1942 | Ewald | 137/355.26 |
| 2,544,119 | 3/1951 | Wolfe | 222/530 X |
| 2,692,092 | 10/1954 | Kinsinger | 242/86.5 R |
| 2,930,199 | 3/1960 | Jarund . | |
| 2,985,404 | 5/1961 | Tashiro | 242/128 |
| 3,225,974 | 12/1965 | Athas | 242/86 X |
| 3,273,813 | 9/1966 | George | 242/54 A |
| 3,379,019 | 4/1968 | Williams . | |
| 3,436,923 | 4/1969 | Lagerstrom . | |
| 3,520,725 | 7/1970 | Hamrick | 137/355.16 X |
| 3,593,943 | 7/1971 | Collmann | 242/129 |
| 3,608,710 | 9/1971 | Pugh | 405/154 |
| 3,744,734 | 7/1973 | Lodato et al. | 242/129 |
| 3,809,333 | 5/1974 | Lefever | 242/129 |
| 3,815,845 | 6/1974 | Rygiol | 242/129 |
| 3,949,778 | 4/1976 | Woodford et al. | 222/529 X |
| 3,999,391 | 12/1976 | Meredith . | |
| 4,040,329 | 8/1977 | Ljunberg . | |
| 4,066,093 | 1/1978 | Egerstrom | 137/355.2 |
| 4,079,592 | 3/1978 | Eakin . | |
| 4,085,492 | 4/1978 | Stange . | |
| 4,116,368 | 9/1978 | Smith | 222/145 |
| 4,151,965 | 5/1979 | Manabe | 242/54 R |
| 4,253,813 | 3/1981 | Farrell, Jr. | 425/90 |
| 4,278,363 | 7/1981 | Choi . | |
| 4,289,427 | 9/1981 | Rolston | 405/260 |
| 4,305,553 | 12/1981 | Coquerel | 242/86 |
| 4,344,553 | 8/1982 | Lesher et al. | 226/168 |
| 4,453,679 | 6/1984 | Thuries et al. . | |
| 4,461,600 | 7/1984 | Norkus et al. . | |
| 4,514,111 | 4/1985 | Issakainen . | |
| 4,589,803 | 5/1986 | Totten, III . | |
| 4,601,518 | 7/1986 | Lanéus . | |
| 4,615,234 | 10/1986 | Chevance et al. | 74/501 R |
| 4,617,715 | 10/1986 | Koistinen et al. . | |
| 4,624,400 | 11/1986 | Zimmer | 242/54 A X |
| 4,643,619 | 2/1987 | Issakainen | 405/303 |

FOREIGN PATENT DOCUMENTS

| | | | |
|---|---|---|---|
| 2526242 | 12/1976 | Fed. Rep. of Germany . | |
| 1460292 | 10/1966 | France | 141/388 |
| 1367404 | 9/1974 | United Kingdom | 242/86 |

*Primary Examiner*—Dennis L. Taylor

*Attorney, Agent, or Firm*—Birch, Stewart, Kolasch & Birch

[57] ABSTRACT

The invention relates to a method and a device for guiding a concrete feeding hose in connection with the grout feedin rock bolting. The concrete feeding hose is therein passed by means of a feeder froma reel into a guide head supported on a feeding beam of a drilling equipment and further through the guide head into a hole drilled in the rock, and is passed back on to the reel in proportion as the hole is filled. In order to protect the feeder of the concrete feeding hose against dirt and mechanical damage, the concrete feeding hose is pushed into the guide head through a flexible guiding means.

21 Claims, 4 Drawing Figures

Figures 1, 2, 3, 4:
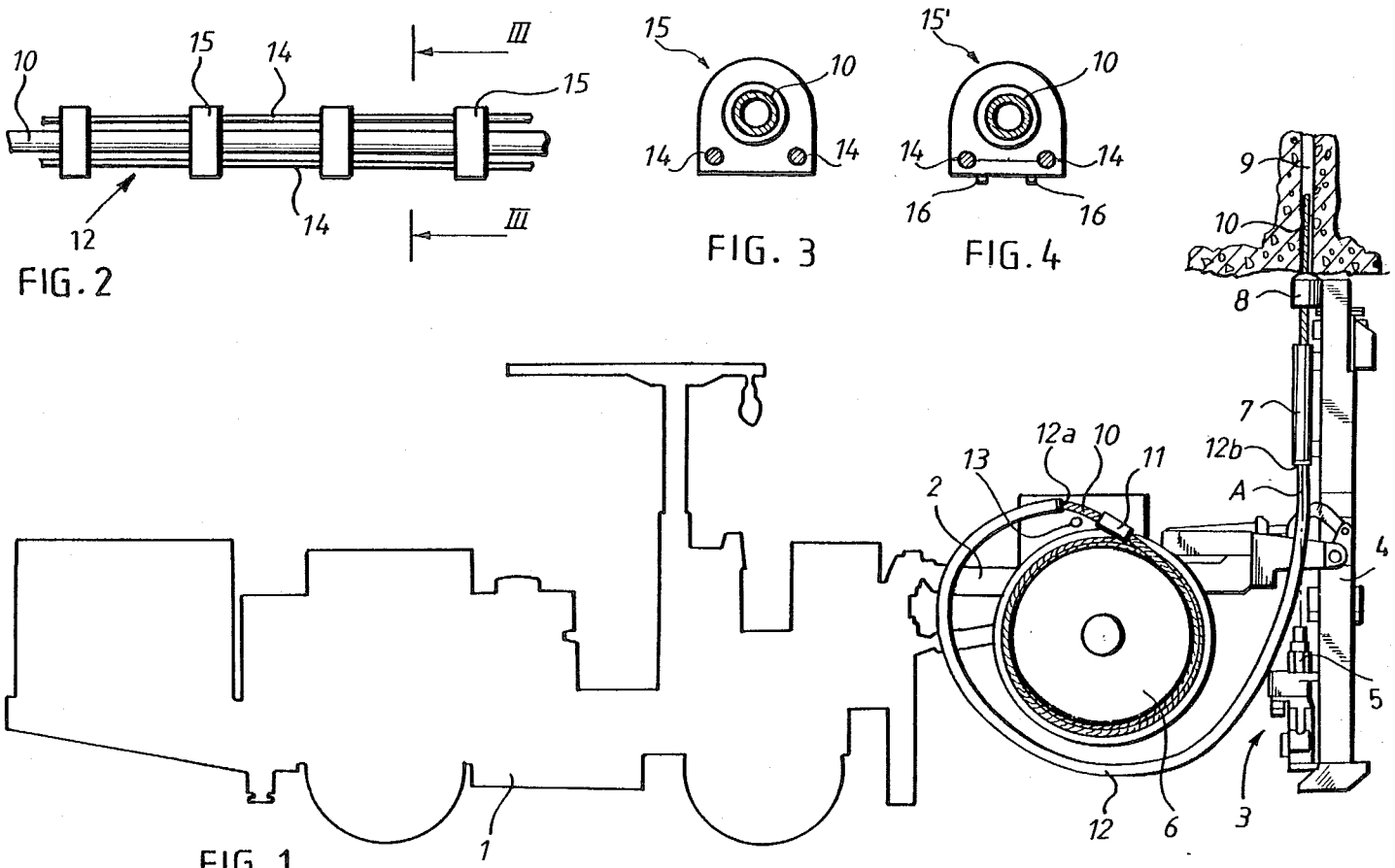

METHOD AND A DEVICE FOR GUIDING A CONCRETE FEEDING HOSE IN CONNECTION WITH THE GROUT FEED IN ROCK BOLTING

The invention relates to a method for guiding a concrete feeding hose in connection with the grout feed in rock bolting, in which method a concrete feeding hose is passed by means of a feeder from a reel into a guide head supported by a feeding beam of a drilling equipment, and further through the guide head into a hole drilled in the rock, and is passed back on to the reel in proportion as the hole is filled. The invention is also concerned with a device for the realization of the method.

In rock bolting, bolts are fastened within holes drilled in the rock by means of grout, e.g. concrete, for the reinforcement of the rock in mines and excavated spaces.

In the grout feed of mechanized rock bolting, feeders for a hose intended for the feed of concrete are mounted stationarily on a combination of a feeding mechanism and a drilling machine. After the feeder, the concrete feeding hose is guided into a drill hole along a rigid guide tunnel. An example of this kind of known device would be the grout feeding device disclosed in Finnish patent application No. 832,124.

However, known solutions are disadvantageous in that the hose feeder is positioned in the vicinity of the drilling equipment, whereby it is liable to dirt and mechanical damage. The feeder of the concrete feeding hose also increases the weight of the feeding beam. In addition, the feeder takes plenty of room and hampers the movements of the feeding beam at narrow drilling sites.

The object of the invention is to provide a method and a device by means of which the above disadvantages can be eliminated. This is achieved by means of a method and a device according to the invention, the method according to the invention being characterized in that the concrete feeding hose is pushed into the guide head through a flexible guiding means. The device according to the invention, in turn, is characterized in that a flexible guiding means for the concrete feeding hose is provided between the feeder of the concrete feeding hose and the guide head.

The invention is based on the idea that instead of drawing the concrete feeding pipe by means of the feeder to the inlet of the guide head or the guide pipe, which is a prior solution, the feeding pipe is now pushed by means of the feeder to the inlet of the guide pipe or the guide head.

The invention is advantageous mainly in that the feeder has been displaced from the drilling head to a sheltered place e.g. on the jumbo carrier or on the drilling boom. Further, the flexible guiding means allows the drilling head to be moved in different directions during the drilling. The flexible guiding means also protects the hose so that it does not get entangled e.g. in the projections of the drilling boom. Additionally, the guiding means supports the hose so that no sharp bends are formed in the hose e.g. when the hose is withdrawn from the hole. Since the flexible guiding means is of fixed dimensions, a further advantage is that the length of the hose to be fed into the drill hole can be advantageously measured at a point which is protected from dirt and mechanical damage. The device according to the invention is very simple in construction and reliable in operation, whereby the manufacturing and operating costs thereof are extremely low.

The invention will be described in the following in more detail with reference to the attached drawing, whereby FIG. 1 is a schematical side view of a rock bolting device to which the present invention has been applied, FIG. 2 is a top view of the principal features of one embodiment of a flexible guiding means according to the invention.

FIG. 3 illustrates the guiding means of FIG. 2 in a sectional view along the line III—III, and FIG. 4 is another embodiment of the detail shown in FIG. 3.

The rock bolting device mainly comprises a carrier 1 which supports a drilling equipment 3 by means of a boom 2. The drilling equipment 3 mainly comprises a feeding beam 4 which is articulated with the boom 2, a drilling machine 5, and a drill rod cassette (not shown). The bolting device further comprises a bolt feeding mechanism which is not shown in FIG. 1. In these parts the bolting device can be similar to the known structure disclosed in e.g. Finnish patent application No. 831,481.

The bolting device also comprises a feeder for the hose which is used for the feeding of grout, e.g. concrete. This feeder mainly comprises a hose magazine, e.g. a reel 6, which is provided within the carrier 1, and a feeding beam 4. The guide head 7 can be turned to the drilling axis A in a manner known per se for guiding the hose into a hole 9 drilled in the rock through a head guide 8 attached to the end of the feeding beam. In the example of FIG. 1, the hose 10 is moved by rotating the reel 6, whereby the hose is unwound from the reel through a guide 11. The rotation machinery of the reel is, in the case of FIG. 1, positioned behind the reel 6, wherefore it is not shown in the figure. The rotation can be effected by means of any suitable motor. The rewinding of the hose is, of course, carried out by rotating the reel 6 in the reverse direction.

The feeder of the hose 10, which feeder is indicated by the reference numerals 6, 11 in the case of FIG. 1, is, according to the invehtion, mounted on the carrier 1, or more precisely on the boom 2, and connected to the rigid guide head 7 by means of the flexible guiding means 12, which guides the hose 10 from the feeder into the guide head. The guiding means is at the ends 12*a*, 12*b* thereof connected to the feeder and the guide head so that its length is constant.

For feeding concrete into the drill hole 9, the feeder is started, whereby the reel 6 starts to rotate, and the concrete feeding hose penetrates through the flexible guiding means 12 into the guide head 7 and further into the drill hole 9. The hose 10 is pushed into the hole to the extent that the end of the hose reaches the bottom of the hole. Thereafter concrete is fed through the hose 10, and the hose is drawn backwards by rotating the reel 6 in the reverse direction.

It is noted that because of the flexible guiding means 12 the feeder can be mounted at a sheltered place on the carrier or on the booms, and, consequently, the feeding beam becomes lighter, and less room is required at the end of the feeding beam. The flexible guiding means allows the feeding beam to be turned at a required drilling angle in each particular case and at a bolting angle with respect to the boom 2. The flexible guiding means 12 also maintains the length of the hose 10 at a constant value, irrespective of the position of the boom and the feeding beam. By virtue threrof, a measuring device 13 indicating the feed length of the hose 10 can be mounted at an advantageous place on the carrier or on the boom.

In the example of FIG. 1, the flexible guiding means 12 is illustrated as a hose, though an open structure would be the most advantageous alternative, because the use of a hose is hampered by the friction.

FIGS. 2 and 3 illustrate a preferred open embodiment of the guiding means 12. The concrete feeding hose is indicated by the reference numeral 10 in FIGS. 2 and 3 as well as in FIG. 1. The flexible guiding means 12 can be formed of at least one supporting element 14 extending substantially in parallel with the hose and having fixed dimensions. In the example of the figures, these supporting elements are advantageously formed by two string cords which are interconnected by means of supporting rings positioned at determined intervals. The supporting rings 15 can be made of a plastic material, preferably nylon. They are attached to the string cords e.g. by means of locking screws. The concrete feeding hose 10 is arranged to go through the supporting rings 15 so that the string cords 14 and the supporting rings 15 together guide the hose 10 in the desired manner so that it does not, for instance, bend sharply during the displacement thereof. It is self-evident that the used guiding means 12 must be sufficiently rigid in order that the bending radii of the hose 10 are kept within reasonable limits. As to the embodiment of FIGS. 2 and 3, it can further be stated that the distance between the supporting rings 15 must be such that the hose 10 does not buckle out from between the rings. In the embodiment of FIG. 4, the supporting rings 15' are formed by two parts interconnected by means of bolts 16 in such a manner that the string cords 14 are positioned between said parts. Such a solution is highly advantageous in view of the assembly and maintenance. The open embodiments of FIGS. 2 to 4 can be fitted in place of the guiding means 12 of FIG. 1.

The embodiments shown in the figures are by no means intended to restrict the invention, but the invention can be modified in various ways within the scope of the claims. Accordingly, the device according to the invention or the parts thereof do not need to be exactly similar to those shown in the figures, but other kind of solutions are possible as well. For instance, the hose feeder does not need to be exactly similar to that shown in FIG. 1; instead, the feeder of the concrete feeding hose, positioned on the frame structure or on the boom, can be similar to that disclosed e.g. in Finnish Patent specification No. 831,481. The term guide head used in the above description and the claims comprehends all kinds of guide pipes and the like rigid guides and guiding means. Besides on the boom, the hose feeder of FIG. 1 can be positioned directly on the carrier as already mentioned above. The flexible guiding means does not, either, need to be similar to that shown in FIGS. 2 and 3, but an open structure can be provided also by means of one, two or four string cords, etc. The term guiding means is here intended to compherend all substantially inextensible flexible structures having a known length and preventing the buckling of the hose when the hose is pushed through the guiding means. Consequently, this kind of guiding means can also be of a reticulate structure or spirally wired, or it can be formed of successive rings connected with each other, etc. The flexible supporting elements can be made of carbon fiber or glass fiber as well. The use of leaf springs is also possible. The supporting elements can be formed by O-rods, square rods, hexagonal rods, etc. Also, it is possible to combine the alternative solutions mentioned above. The supporting elements can thus be any flexible, shape permanent elements which control the bending of the hose in a desired manner. The supporting rings used in the embodiments of FIGS. 1 to 4 can also be effected in some other way than that shown in the figures.

What is claimed is:

1. A method for guiding a concrete feeding hose in connection with the grout feed in rock bolting, said method comprising the steps of passing a concrete feeding hose by means of a feeder from a reel into a guide head supported by a feeding beam of a drilling equipment, passing said feeding hose further through the guide head into a hole drilled in the rock, and passing said feeding hose back on to the reel in proportion as the hole is filled, said concrete feeding hose being pushed into the guide head through a flexible guiding means.

2. A method according to claim 1, wherein the pushing of the concrete feeding hose is carried out by means of a feeder mounted on a carrier which supports the feeding beam.

3. A method according to claim 1, wherein the pushing of the concrete feeding hose is carried out by means of a feeder mounted on a drilling boom which supports the feeding beam.

4. A method according to claim 1 wherein the concrete feeding hose is guided by means of a flexible guiding means between the feeder and the guide head.

5. A device for guiding a concrete feeding hose of in a rock bolting device, comprising a feeding beam and a drilling equipment thereof which are supported on a carrier and a drilling boom, a guide head which is supported on the feeding beam and which guides the concrete feeding hose into a drill hole, a feeder for passing the concrete feeding hose into the hole and for drawing it out of the hole, feeding means for feeding concrete into the hole through the feeding hose, and a feeding mechanism for pushing a bolt into the drill hole, said device further comprising a flexible guiding means for the concrete feeding hose, said flexible guiding means being provided between the feeder of the concrete feeding hose and the guide head.

6. A device according to claim 5, wherein the guiding means is at one end thereof attached to the guide head and at the other end thereof to the feeder.

7. A device according to claim 5, wherein the feeder is mounted on the carrier.

8. A device according to claim 5, wherein the feeder is mounted on the drilling boom.

9. A device according to claim 5, wherein the flexible guiding means is a hose.

10. A device according to claim 5, wherein the flexible guiding means is formed by at least one flexible supporting element which extends substantially in the direction of the hose, is fixed in dimensions, and provided with supporting rings attached thereto at determined intervals, whereby the concrete feeding hose is arranged to go through said rings.

11. A device according to claim 10, wherein the flexible guiding means is formed by two string cords which act as supporting elements and to which the supporting rings, made of a plastic material, are attached.

12. A method according to claim 2, wherein the concrete feeding hose is guided by means of a flexible guiding means between the feeder and the guide head.

13. A method according to claim 3, wherein the concrete feeding hose is guided by means of a flexible guiding means between the feeder and the guide head.

14. A device according to claim 6, wherein the feeder is mounted on the carrier.

15. A device according to claim 6, wherein the feeder is mounted on the drilling boom.

16. A device according to claim 6, wherein the flexible guiding means is a hose.

17. A device according to claim 7, wherein the flexible guiding means is a hose.

18. A device according to claim 8, wherein the flexible guiding means is a hose.

19. A device according to claim 6, wherein the flexible guiding means is formed by at least one flexible supporting element which extends substantially in the direction of the hose, is fixed in dimensions, and provided with supporting rings attached thereto at determined intervals, whereby the concrete feeding hose is arranged to go through said rings.

20. A device according to claim 7, wherein the flexible guiding means is formed by at least one flexible supporting element which extends substantially in the direction of the hose, is fixed in dimensions, and provided with supporting rings attached thereto at determined intervals, whereby the concrete feeding hose is arranged to go through said rings.

21. A device according to claim 8, wherein the flexible guiding means is formed by at least one flexible supporting element which extends substantially in the direction of the hose, is fixed in dimensions, and provided with supporting rings attached thereto at determined intervals, whereby the concrete feeding hose is arranged to go through said rings.

* * * * *